US007575641B2

(12) United States Patent
Joseph

(10) Patent No.: US 7,575,641 B2
(45) Date of Patent: Aug. 18, 2009

(54) METHOD AND SYSTEM FOR CLEANING HEAT EXCHANGER TUBE BUNDLES

(75) Inventor: Carroll E. Joseph, Leetonia, OH (US)

(73) Assignee: National Heat Exchange Cleaning Corp., Columbiana, OH (US)

( * ) Notice: Subject to any disclaimer, the term of this patent is extended or adjusted under 35 U.S.C. 154(b) by 631 days.

(21) Appl. No.: 11/307,816

(22) Filed: Feb. 24, 2006

(65) Prior Publication Data

US 2006/0185691 A1 Aug. 24, 2006

Related U.S. Application Data

(63) Continuation of application No. PCT/IB2005/051909, filed on Jun. 9, 2005.

(60) Provisional application No. 60/656,430, filed on Feb. 24, 2005.

(51) Int. Cl.
*B08B 3/02* (2006.01)

(52) U.S. Cl. ..... 134/21; 134/22.1; 134/22.18; 134/32; 134/144; 134/166 R; 134/169 R; 134/170; 165/95

(58) Field of Classification Search ..... 134/10, 134/11, 21, 22.1, 22.18, 34, 37, 108, 111, 134/144, 166 R, 169 R, 170; 165/5, 95
See application file for complete search history.

(56) References Cited

U.S. PATENT DOCUMENTS 3,052,245 A 9/1962 Nagle
4,322,868 A * 4/1982 Wurster ..... 15/302
4,458,704 A * 7/1984 Higdon ..... 134/57 R
4,509,544 A 4/1985 Mains, Jr.
5,018,544 A 5/1991 Boisture et al.
5,246,023 A 9/1993 Breunsbach et al.
5,437,296 A 8/1995 Citino
5,509,972 A 4/1996 Akazawa et al.
6,142,169 A 11/2000 Lees et al.
6,283,133 B1 9/2001 Furuta et al.

OTHER PUBLICATIONS

International Preliminary Examination Report for PCT/IB05/51909.
Supplementary European Search Report, EP Application No. 05 74 6570, dated Mar. 11, 2008.

* cited by examiner

*Primary Examiner*—Michael Barr
*Assistant Examiner*—Saeed T Chaudhry
(74) *Attorney, Agent, or Firm*—Hahn Loeser & Parks, LLP

(57) ABSTRACT

A method and system utilizing a mobile cleaning unit for providing cleaning of heat exchanger tube bundles. The mobile cleaning unit utilizes a pressurized seal positioned about top door of the cleaning enclosure to provide a fluid and vapor lock of the cleaning enclosure. An oxygen purging system of the cleaning enclosure, the cleaning fluid reservoir, and the control panels provides additional safety. The mobile cleaning unit can use cleaning fluid produced at the facility site and return the cleaning fluid to the facility site for reprocessing after the heat exchanger tube bundles are cleaned.

20 Claims, 8 Drawing Sheets

METHOD AND SYSTEM FOR CLEANING HEAT EXCHANGER TUBE BUNDLES

This application is a continuation of PCT International Application Number PCT/IB2005/051909 filed Jun. 9, 2005, which claims the benefit of U.S. Provisional Patent Application Ser. No. 60/656,430, filed Feb. 24, 2005, both applications hereby incorporated by reference.

TECHNICAL FIELD

The present invention relates to a method and system for cleaning heat exchanger tube bundles and, more particularly, to a method and system for providing a safe, economical, and environmentally friendly cleaning of heat exchanger tube bundles using cleaning fluid produced on site and reprocessed on site, such that long distance transport of cleaning solution is not required.

BACKGROUND OF THE INVENTION

A mobile cleaner for heat exchanger tube bundles is disclosed in commonly owned U.S. Pat. No. 5,437,296. While the prior art mobile cleaner provided an adequate cleaning of the heat exchanger tubes, it had several problems associated with its use. The first problem was that the prior art system vented some of the fumes from the cleaning solution directly into the atmosphere. Government agencies are now paying increased attention to the release of fumes into the atmosphere and have promulgated various rules and regulations concerning proper handling of vapor emissions. Another problem involved the two top doors that did not completely seal against the top of the container or with each other, allowing escape of fumes and possibly cleaning fluid. The method of cleaning with the prior art mobile unit involved transporting the cleaning fluid to the site where the cleaning would take place, cleaning, and then transporting the used cleaning material for disposal or reprocessing. The prior art mobile cleaner also required extensive set up time to change roller positions to accommodate different sized tube bundles. These and other problems associated with the prior art identify a need for a new method and system for cleaning heat exchanger tube bundles.

SUMMARY OF THE INVENTION

The present invention overcomes at least one of the problems identified in the prior art by providing a method of cleaning a heat exchanger bundle comprising the steps of: providing a mobile cleaning unit having a cleaning enclosure accessible by a top door and having a cleaning fluid reservoir; opening the top door of the cleaning enclosure to provide access thereto; loading at least one heat exchanger tube bundle into the cleaning enclosure; closing the top door of the mobile cleaning unit and pressurizing a seal positioned about top door to provide a fluid and vapor lock of the cleaning enclosure; purging oxygen from at least one of the enclosure, the cleaning fluid reservoir, and a control panels by filling at least one of the enclosure, the reservoir, and the control panels with nitrogen; and cleaning the heat exchanger tube bundle by spraying the cleaning fluid on the bundle.

At least one embodiment of the present invention also provides a system for cleaning heat exchanger tube bundles comprising: a mobile cleaning unit comprising a tube bundle receiving reservoir enclosure having a bottom, upstanding opposing sidewalls and end walls, and a door pivotally secured to one of said sidewalls; a means for moving the door to open and close the tube bundle receiving reservoir enclosure; a cleaning fluid sump in communication with the tube bundle receiving reservoir enclosure; a plurality of drive roller assemblies and guide roller assemblies positioned in the tube bundle receiving reservoir enclosure to receive the heat exchanger tube bundles; an adjustable spray means positioned in the tubular bundle receiving reservoir enclosure for spraying a cleaning fluid over the length of the heat exchanger tubular bundle; a pump and filter assembly for recirculating the cleaning fluid from the sump to the adjustable spray means; a cleaning fluid supply reservoir interconnected with the sump; a means for heating the cleaning fluid in the supply reservoir prior to recirculating through the pump and filter assembly; a means for controlling the drive roller assembly, the pump and filter assembly, and the means for heating the cleaning fluid in the cleaning fluid supply reservoir, the controlling means comprising a plurality of explosion-proof control elements housed in a cabinet, and a vapor lock seal comprising an interior chamber, the seal positioned about the top of the reservoir enclosure and sealingly engaging the door when the interior chamber of the seal is pressurized with a source of gas.

These and other advantages will be apparent upon review of the drawings and the detailed description of the invention.

BRIEF DESCRIPTION OF THE DRAWINGS

This invention will now be described in further detail with reference to the accompanying drawings, in which.

DETAILED DESCRIPTION OF THE INVENTION

Figure 1:
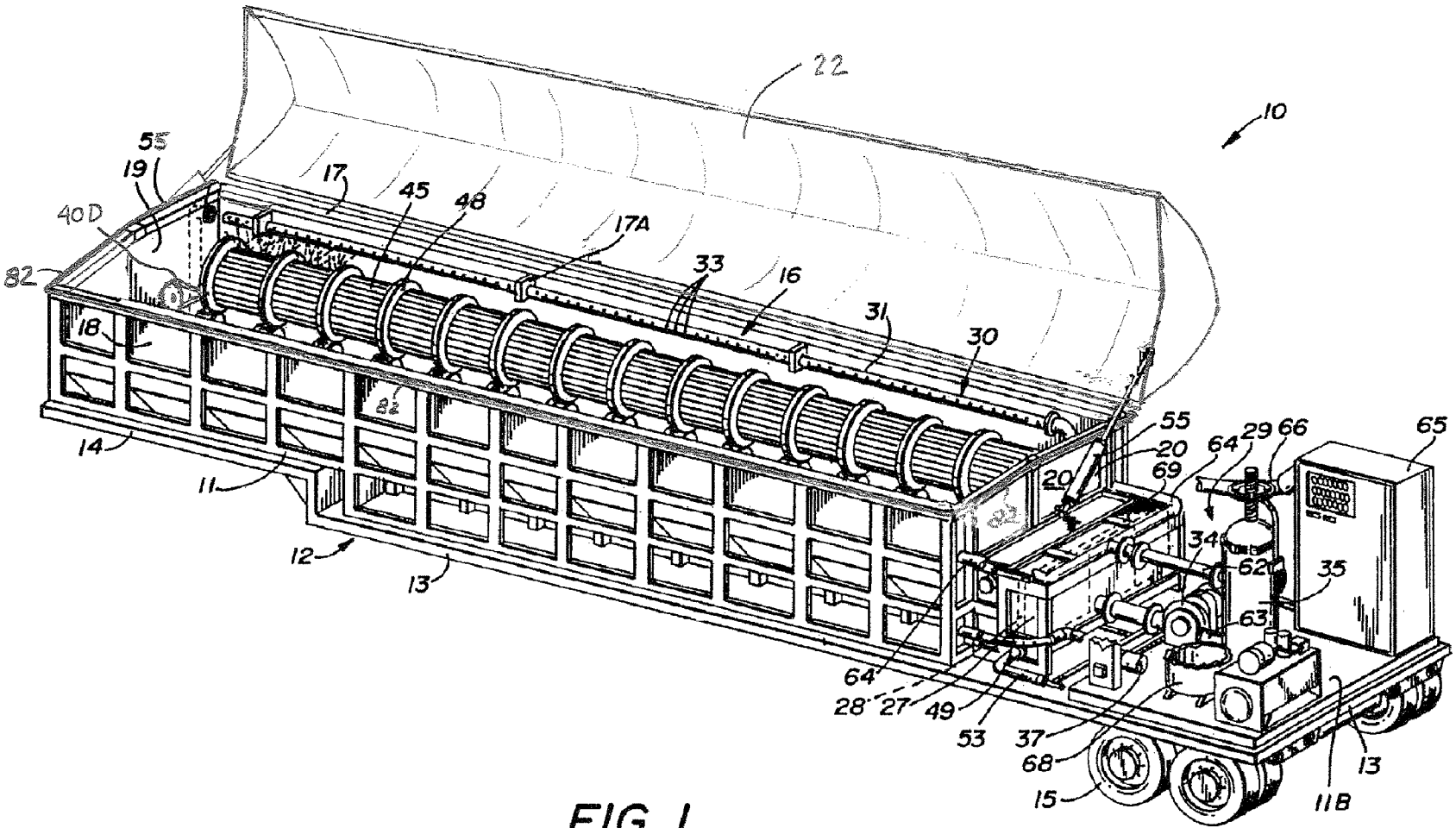
FIG. 1 is a perspective view of a portion of the heat exchanger tube bundle cleaning device illustrating a mobile reservoir with portions broken away.

Referring to FIGS. 1-4 of the drawings, a mobile self-contained heat exchanger tube bundle cleaning device 10 can be seen having a mobile base 11 mounted on a trailer configuration 12 having a bed 13 and a trailer hitch portion 14 with associated wheel assemblies 15 thereon. While shown as a trailer configuration, the unit 10 is also contemplated as an integral frame unit that is transported to a location on a flatbed or the like and dismounted at the facility where the cleaning is to take place.

The mobile base 11 includes a main tube bundle receiving reservoir enclosure 16 having spaced, oppositely disposed sidewalls 17 and 18 integral respective end walls 19 and 20 and an interconnected bottom structure 21. The main tube bundle receiving reservoir enclosure 16 has a domed top door 22 that is pivotally secured to the upper edges of sidewall 17. The door 22 pivots inwardly towards sidewall 18 forming an enclosed sealed cleaning area within the tube bundle receiving reservoir enclosure 16 at 24.

A cleaning fluid supply reservoir 25 is positioned directly below a portion of said bottom structure 21 of the bundle receiving reservoir enclosure 16 defining an elongated rectangular tank, see FIGS. 4, 5 and 6 of the drawings. The cleaning fluid supply reservoir 25 is positioned centrally to the tube bundle receiving reservoir enclosure 16 thereabove and supplies all of the cleaning fluid required in the mobile self-contained configuration. The reservoir 16 is filled at the cleaning site with cleaning fluid and is emptied after cleaning is complete. A plurality of heating elements 25A are positioned in spaced, longitudinal relation within the cleaning fluid supply reservoir 25 for heating of a cleaning fluid solution within to operational temperatures up to 200 degrees Fahrenheit. The elevated temperature significantly increases the effectiveness of the cleaning fluid. A typical formulation for the cleaning fluid would be Naptha or solvents including Naptha such as Suresol 100, or any other petroleum distillate that is a product or by-product at the facility having the heat exchangers. It is also contemplated that various chemical cleaning solutions could also be used as the cleaning fluid such as acids or caustic solutions.

A recirculation and filter sump 27 is positioned directly adjacent the respective ends of said main tube bundle receiving reservoir enclosure 16 and the cleaning fluid supply reservoir 25. The recirculation and filtering sump 27 is in direct communication with the main reservoir 16 for receiving used cleaning fluid therefrom. The recirculation and filter sump 27 has multiple particle filter screens 28 positioned within for initial fluid filtering of the used cleaning fluid within the recirculation system.

A main pump and filter assembly 29 are on a secondary mobile base 11B which is positioned on the trailer bed 13 adjacent to and in communication with the recirculation and filter sump 27 to provide cleaning fluid under pressure to a spray nozzle assembly 30 within said main tubular bundle receiving reservoir enclosure 16.

Figure 3:
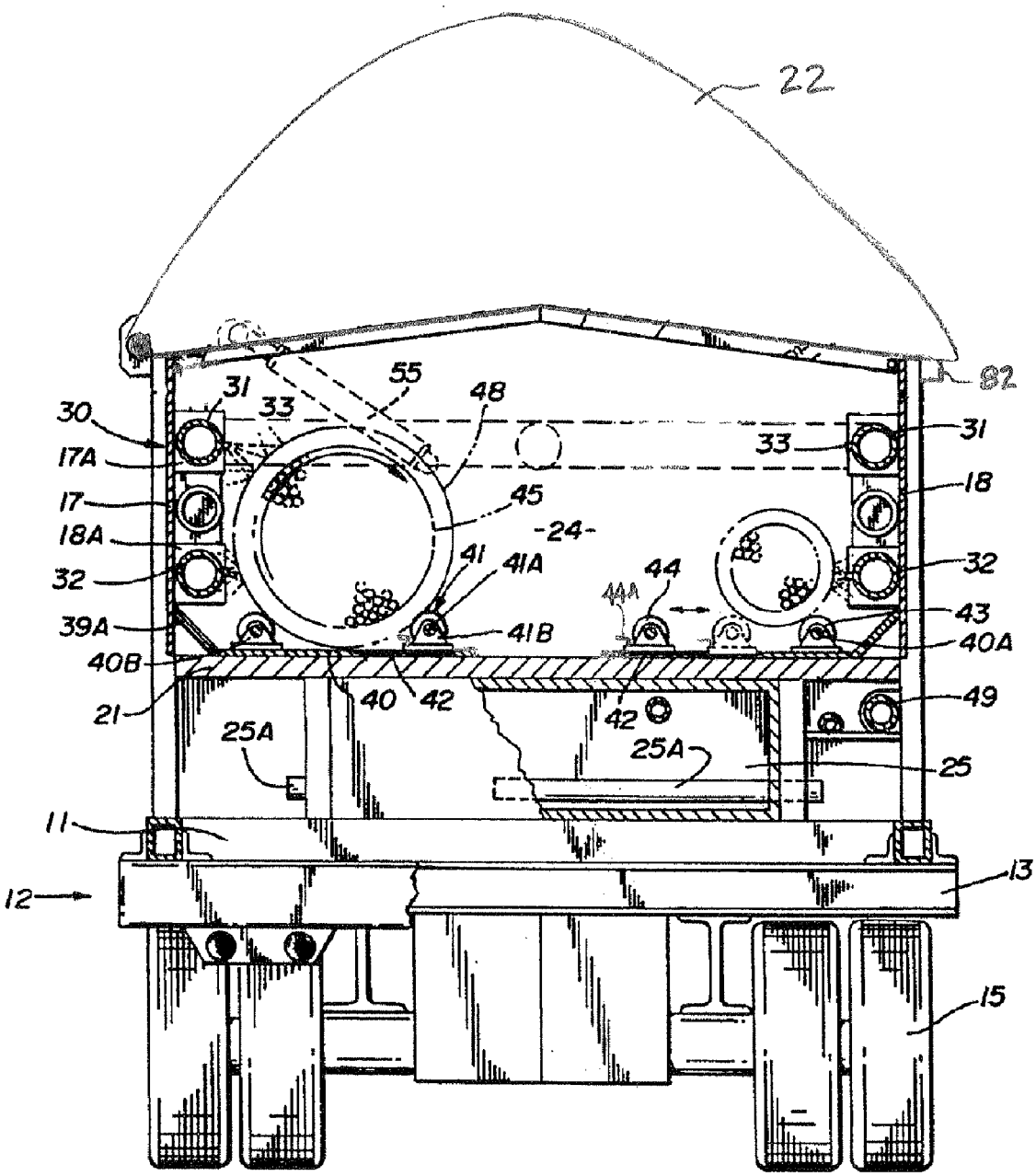
FIG. 3 is an end cross-sectional view of the heat exchanger tube bundle cleaning device illustrating heat exchanger tube bundles shown in broken lines as positioned during use.

The spray nozzle assembly 30 includes pairs of nozzle support and supply manifolds 31 and 32 extending in spaced parallel relation to one another along said respective sidewalls 17 and 18 by adjustable manifold support brackets 17A and 18*a*, best seen in FIG. 3 of the drawings.

Each of the supply manifolds have a plurality of fixed longitudinally spaced inwardly facing spray nozzles 33 therein forming an overlapping two level spray pattern within the heat exchanger tube bundle receiving reservoir enclosure 16. The supply manifolds 31 and 32 can be rotated on their longitudinal axis within the adjustable manifold support bracket 17A and 18A so that the relative positioning of the nozzles 33 can be directed and repositioned in relation to the main tube bundle receiving reservoir enclosure 16. The pump and filter assembly 29 includes a pump 34 and a high volume filter 35 interconnected thereto by supply lines 36 and associated valving as will be well known to those skilled in the art.

Figure 5:
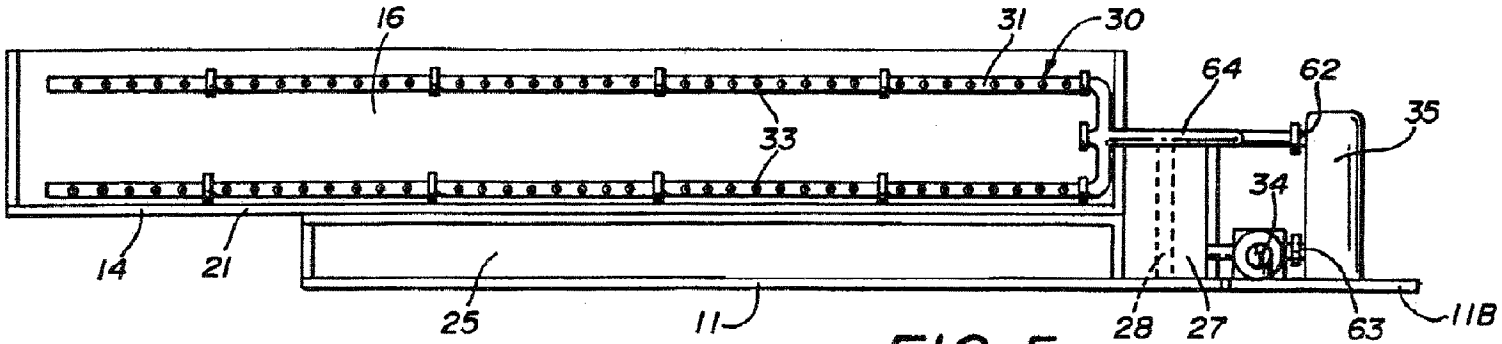
FIG. 5 is a graphic illustration of the heat exchanger tube bundle cleaning device showing the relative relationship of the associated reservoirs and circulation pumps, etc.
Figure 6:
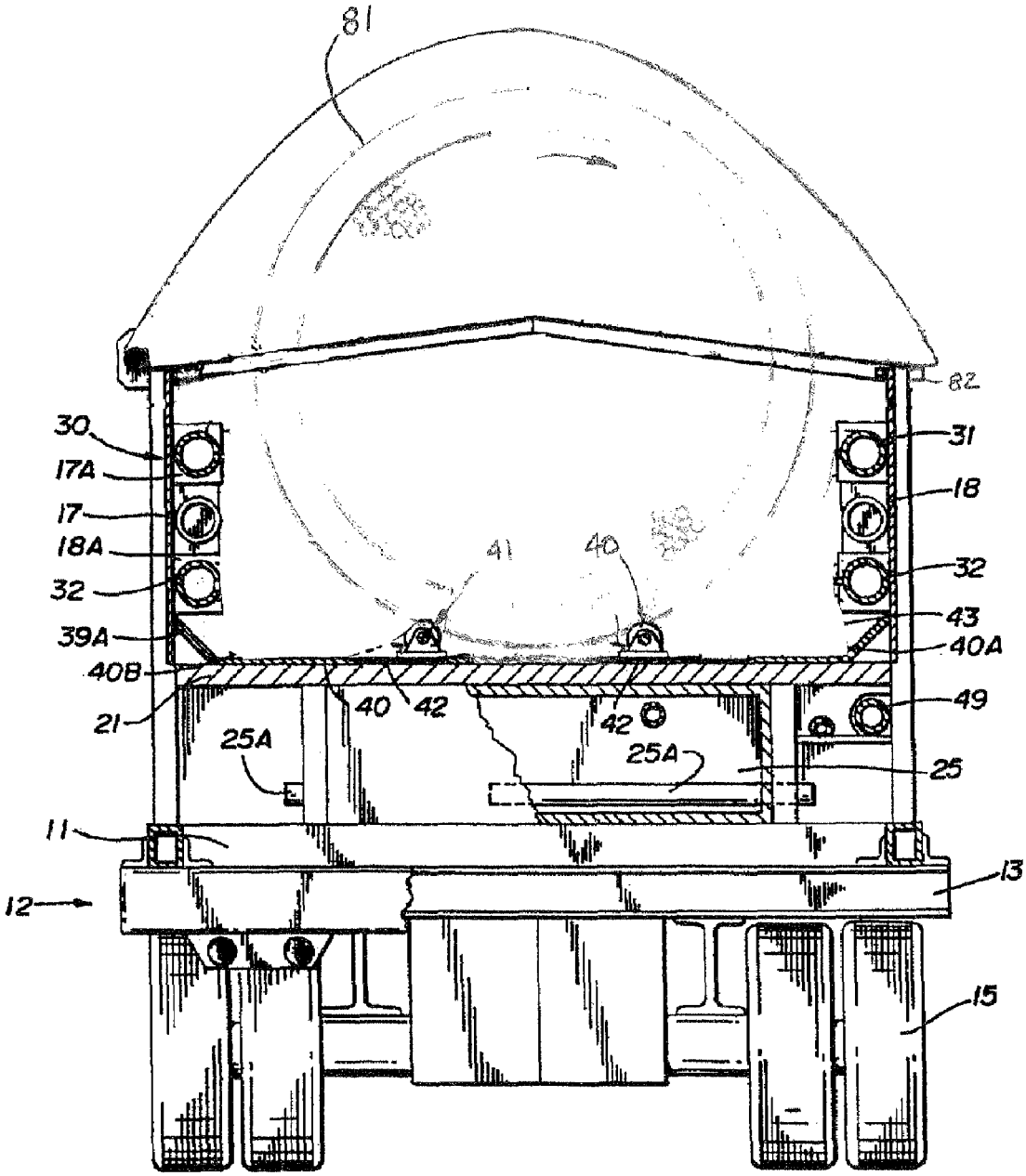
FIG. 6 is an end cross-sectional view of the heat exchanger tube bundle cleaning device shown in a configuration for cleaning large single tubular heat exchanger tube bundles.

A secondary pump assembly 37 is used to initially fill the heat exchanger tube bundle receiving reservoir enclosure 16 and the recirculation and filtering sump 27 from the cleaning fluid supply reservoir 25 as best seen in FIG. 5 of the drawings.

Referring back to FIGS. 1-3 of the drawings, it will be seen that the bottom of the heat exchanger tube bundle receiving reservoir enclosure 16 is flat with at least one drive roller assembly 40 and a guide roller assembly 41 mounted thereon. The configuration shown comprises a set-up for two heat exchanger bundles. Drive roller assembly 40 includes variable speed hydraulic motors 40C mounted on end wall 19 turning a sprocket and chain assembly 40D for turning drive roller assembly 40. The variable speed hydraulic motors 40C allow continuous turning of the rollers or a jog feature that rotates a predetermined amount and then stops to allow cleaning while the bundle is stopped. The motors also provide additional torque over prior art systems. Each of said respective guide roller assemblies 41 can be adjusted transversely within said tube bundle support area TSA by moving within respective guide channels 42 towards and away from the elongated raised center portion 38 best seen in FIGS. 2 and 3 of the drawings. It is noted that prior art systems required the guide roller assemblies to be individually bolted in position. In the present configuration, the roller assemblies 41 are slid into position and then clamped into place with a quick connect release mechanism such as pull pins 44A, thus significantly reducing set up time for different sized bundles.

Figure 4:
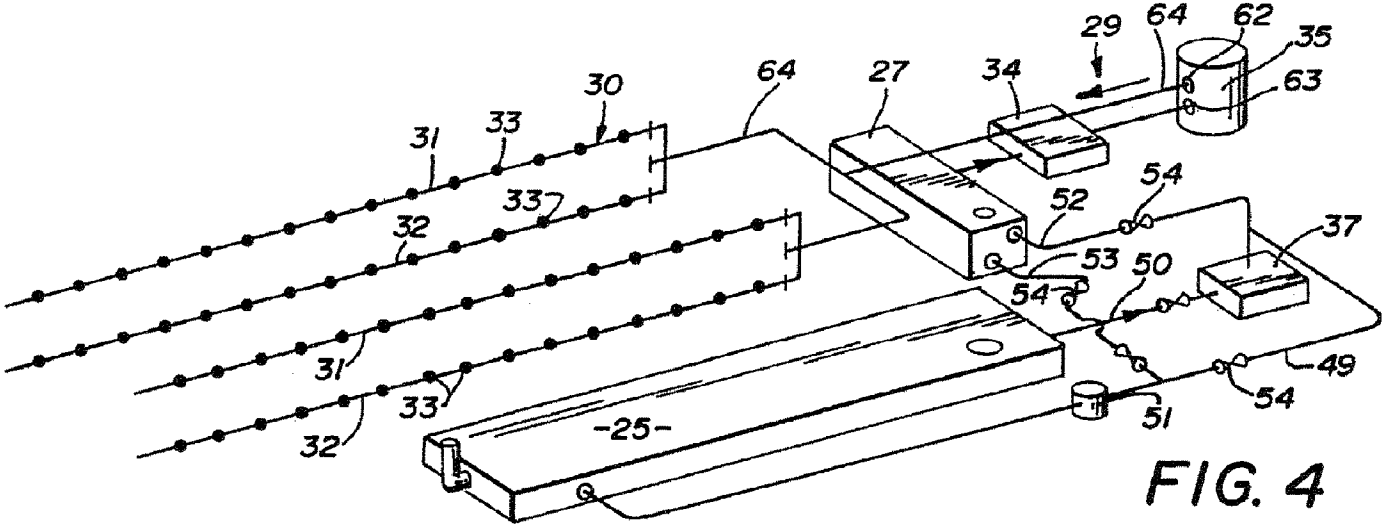
FIG. 4 is a graphic perspective schematic illustration of the cleaning fluid flow path and associated pumping and filtering apparatus and spray nozzles within the invention.

Each of the longitudinally spaced guide channels 42 extend between sidewall angles 39A and the raised center section 38 so that each of the guide roller assemblies 41 can be moved towards the respective drive roller assembly as seen in broken lines in FIG. 4. Each of the respective drive and guide roller assemblies 40 and 41 include keyed main support shafts 40A and 40B extending through multiple bearing elements 40B and 41B. Multiple pairs of rollers 43 and 44 are positioned on said respective support shafts 40A and 40B in spaced longitudinal alignment so that they can be adjusted and moved along the keyed support shafts 40A and 40B to conform to the engagement area of a heat exchanger tube bundle 45 to be positioned in horizontally aligned relation thereon.

Figure 2:
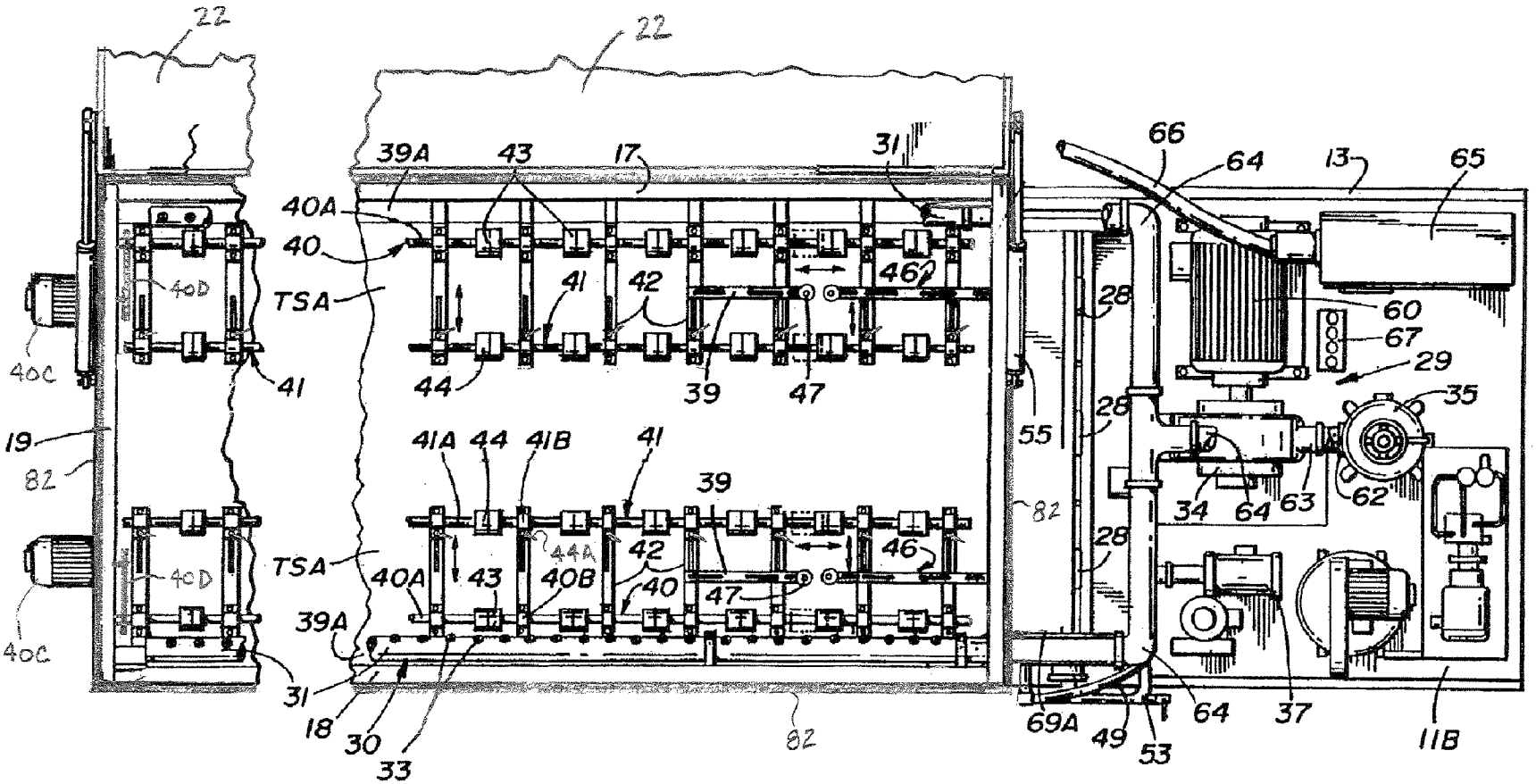
FIG. 2 is a top plan view of the heat exchanger tube bundle cleaning device with portions broken away.

Referring now to FIG. 2 of the drawings, thrust bearing assemblies 46 can be seen within the heat exchanger tube bundle receiving reservoir enclosure 16 between the respective drive and guide roller assemblies 40 and 41. Each of these thrust bearing assemblies 46 have a pair of longitudinally spaced adjustable bearing rollers 47 mounted horizontally on adjustable slotted support brackets 39 secured to the floor 21 between said drive and guide roller assemblies 40 and 41 adjacent the recirculation and filter sump 27.

The heat exchanger tube bundle 45 typically has an apertured end mounting plate or tubesheet 48 of an increased diameter that will register between said adjustable bearing rollers 47 of the thrust bearing assembly 46 positioning and holding the heat exchanger bundle 45 in longitudinal alignment during rotation by the drive roller assembly 40 as hereinbefore described.

Referring to FIG. 4 of the drawings, a graphic illustration of the fluid flow paths associated with the cleaning fluid are illustrated wherein the cleaning fluid supply reservoir 25 is connected to the secondary pump assembly 37 by multiple supply and return lines 49 and 50 and interconnected filter 51. Recirculation and filter sump supply lines 52 and 53 provide selected filling of the sump 27 and the interconnected heat exchanger tubular tube bundles reservoir enclosure 16 by a plurality of control and check valves 54 as will be well known and understood by those skilled in the art. This arrangement allows for initial heating and recirculation of the cleaning fluid from the cleaning fluid supply reservoir 25 through the filter 51 in a closed loop. Once the cleaning fluid is up to operating temperature the appropriate control valves 54 are activated to fill the sump 27 and interconnected heat exchanger tube bundle receiving reservoir enclosure 16. Referring to FIGS. 1-4 the door 22 hereinbefore described has a hydraulic piston and cylinder assembly 55 pivotally connected to opposing ends of door 22. The piston and cylinder assembly pair act together to open and close the door 22 for insertion and removal of the heat exchanger tube bundle 45 within.

Figure 7:
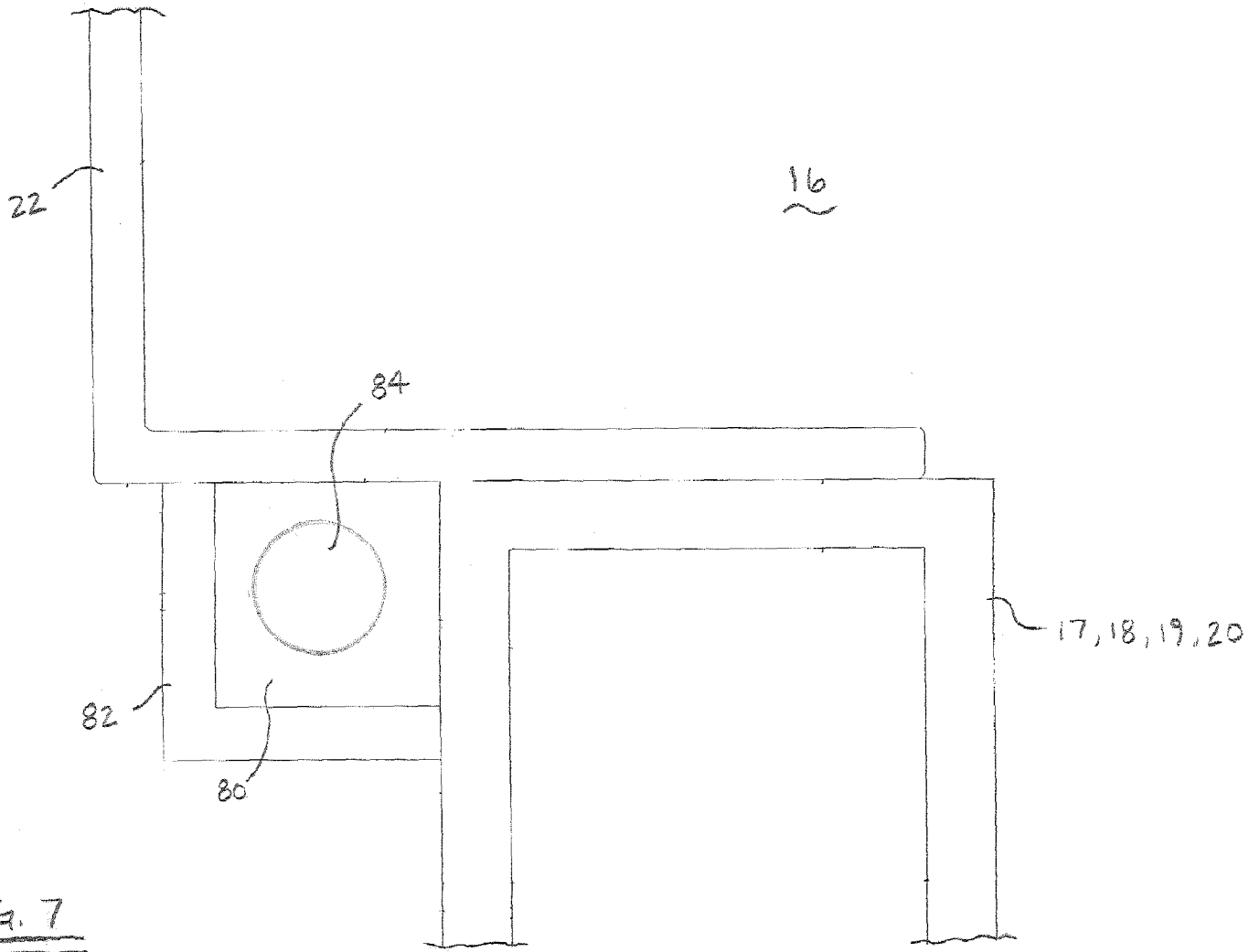
FIG. 7 is a cross-sectional view of the sealing system of the present invention.

Referring now to FIG. 7, positive sealing system is used to provide a liquid and vapor lock between the door 22 and sidewalls 17 and 18 and ends 19 and 20 (completely around the top of the heat exchanger tube bundle receiving reservoir enclosure 16). A rubber seal 80 is housed in a continuous channel 82 positioned adjacent to the sidewalls 17 and 18 and ends 19 and 20 (see also FIGS. 1-3 and 6). The seal 80 is made of a rubber material and has a hollow interior 84. When the door 22 is closed, the interior 84 of the seal 80 is pressurized with Nitrogen gas. The seal 80 is forced against the door 22 creating a positive vapor seal to prevent loss of vapors and spray loss during use. A purge system 110 is then provided to extract extraneous fumes from within the enclosed space 16 and process the fumes through disposable carbon filter canisters as discussed in greater detail below. When the door 22 is opened, the Nitrogen gas in the seal 80 is unpressurized, unsealing the door 22 and the enclosure 16.

Referring to FIGS. 1 and 2 the second mobile base 11B can be seen on which is positioned the main pump and filter assembly 29 as hereinbefore described. The high volume filter 35 can be seen connected to a main pump 34 and interconnected motor 60. The high volume filter 35 has spaced vertical inlets and outlets 62 and 63. Filter screens (not shown) are positioned within a pressure vessel of the high volume filter 35 that is a modification of a commercially available filter strain assembly manufactured by W. M. Nugent and Company, model no. 1554-206B-SN150 or DACRON® sock filters available from various suppliers.

In operation, the tube bundles 45 are lowered into the heat exchanger tube bundle receiving reservoir enclosure 16 and positioned on respective drive and guide roller assemblies 40 and 41 and thrust bearing assemblies 46 which have been adjusted to the required spacing for respective tube bundle as hereinbefore described. The door 22 is closed defining the enclosed area. The cleaning fluid is heated within the cleaning fluid reservoir 25 by the plurality of heaters 25A positioned within and then pumped to the sump 27 partially filling the heat exchanger tubular bundle receiving reservoir enclosure 16 to the desired level partially submerging the respective heat exchanger tube bundles 45 within. The main pump and motor assembly 29 circulates cleaning fluid from the sump 27 through a supply line 64 to the hereinbefore described manifolds 31 and 32 at approximately 1200-1500 GPM. The spray nozzle assemblies 30 provides a continuous overlapping spray pattern on the heat exchanger tube bundles 45 which are rotated on the multiple drive and guide roll assemblies 40 and 41. The cleaning fluid is thus circulated through the sump 27 and its primary filters 28 best seen in FIG. 2 of the drawings. Upon completion of the cleaning cycle, which will vary depending on the size of heat exchanger tube bundles 45 and condition of same the cleaning fluid solution is drained back into the cleaning fluid storage reservoir 25 for future use.

The coking of hot process liquid that circulates around and through the exterior surfaces of the individual tubes of the heat exchanger tube bundles 45 builds up on the exterior surface of the tubes and reduces thermal transfer, thereby diminishing the efficiency of the heat exchanger tube bundles 45. Removal of the build up residue is critical requirement of the heat exchanger tube bundles for continued high efficiency use as is required.

While the exterior of the individual tubes of the heat exchanger tube bundles are cleaned using the device and method of the present invention, the interior of the heat exchanger tubes are typically cleaned internally by high pressure water and abrasive plugs (not shown) which are forced through the individual tubes as is available in common practice at the present time. The present invention may also have the benefit of softening up the build-up in the interior of the heat exchanger tubes by partially soaking the tubes in the heated cleaning fluid during the cleaning process. When the interior build-up is softened, the internal cleaning using high pressure water and abrasive plugs is easier.

Hydraulic and electrical control for the heat exchanger tube bundle cleaning apparatus are achieved by an electrical control panel 65 having a power supply cable 66 and a hydraulic control valve assembly 67. The electrical control panel 65 is completely explosion proof and is further connected to purge system 110 as discussed below.

The various operational equipment that are required to run the cleaner are positioned on the secondary mobile base 11B such as air compressor 68, etc. as best seen in FIGS. 1 and 2 of the drawings. The controls for the compressor 68, main pump and filter assembly 29, hydraulic motors, electrical connection boxes/connectors and all operational equipment are all explosion proof such that no sparks can be created that might ignite vapors from the cleaning fluid.

Referring back to FIG. 1, the recirculation and filter sump 27 has an access door 69 which has been removed in FIG. 2 for illustration purposes only. The access door 69 allows the operator to remove and clean filter elements 28 which are removably positioned within a support framework 69A which separates the sump 27 and is positioned in spaced relation to an intake opening 70 within the sump. Referring now to FIG. 6, an alternate configuration can be seen for use with a single large heat exchanger tube bundle 81 shown in broken lines. The large heat exchanger tube bundle 81 is positioned on drive roller assembly 40 and guide roller assembly 41. The domed door 22 is closed as illustrated in FIG. 6 and is able to accommodate the increased heat exchanger tube bundle size.

Figure 8:
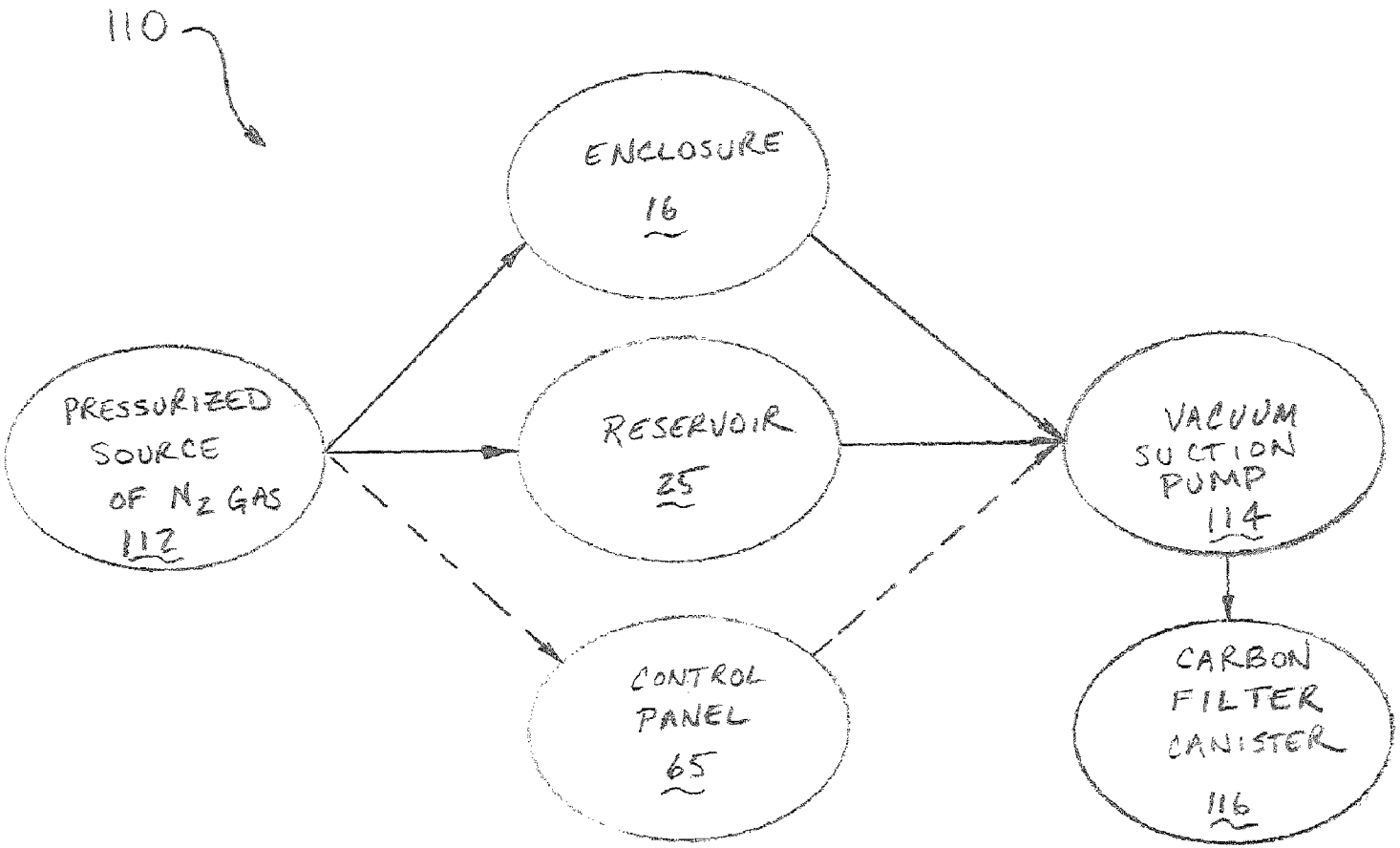
FIG. 8 is a diagram depicting the venting system of the present invention.

The present invention includes a purge system 110, depicted schematically in FIG. 8, provided to capture extraneous fumes within the enclosed areas of the heat exchanger tube bundle cleaning device 10. The purge system 110 comprises a pressurized source of Nitrogen gas 112 connected to cleaning enclosure 16, fluid supply reservoir 25, and, optionally, control panel 65. The purge system 110 further comprises a suction pump 114. Cleaning enclosure 16, fluid supply reservoir 25, and, optionally, control panel 65 have an exhaust line connected to the suction pump 114 to create a vacuum to capture any extraneous fumes within the enclosed spaces 16, 25 and 65. The suction pump 114 is connected to a carbon canister 116. The canister 116 may be portable or attached to the heat exchanger tube bundle cleaning device 10. It is noted that the purge system 110 includes purging of the total fluid system including filters, sump, etc. The purge system 110 provides an extra safety measure to prevent venting of fumes to the atmosphere and to prevent the possibility of explosion caused by ignition of the fumes by lowering the oxygen level below 19.5%.

Figure 9:
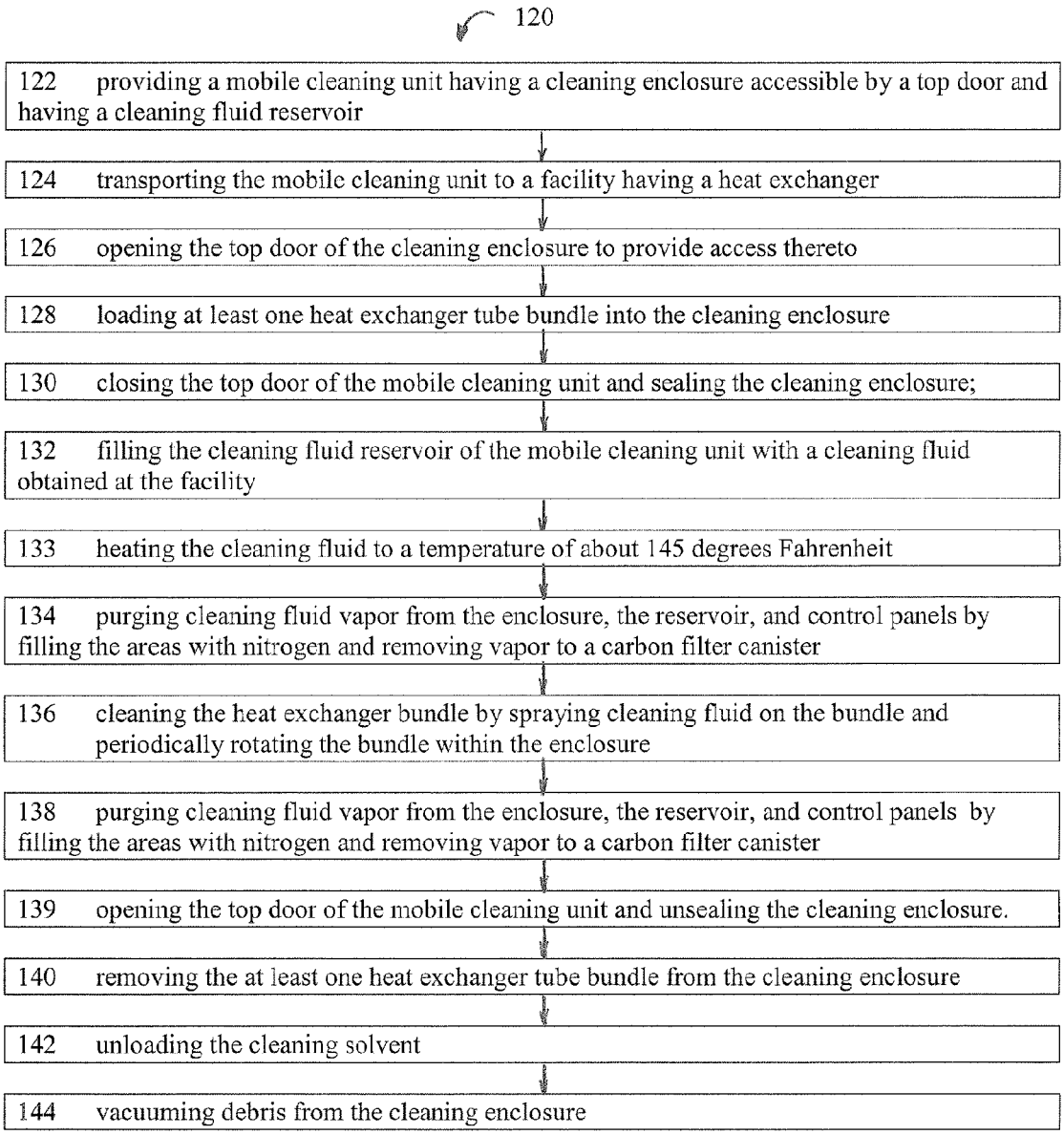
FIG. 9 is a diagram showing the method of the present invention.

The method 120 of cleaning using the heat exchanger tube bundle cleaning device 10 is now discussed with reference to FIG. 9. A mobile cleaning unit 10 having a cleaning enclosure 16 accessible by a top door 22 and having a cleaning fluid reservoir 25 is provided 122 and transported 124 to a facility having a heat exchanger. The top door of the cleaning enclosure 16 is opened 126 to provide access thereto. A heat exchanger tube bundle is loaded 128 into the cleaning enclosure 16. The top door of the mobile cleaning unit is closed 130 and the positive seal 80 is pressurized to seal the cleaning enclosure 16. The cleaning fluid reservoir 25 of the mobile cleaning unit 10 is filled 132 with a cleaning fluid obtained at the facility. The cleaning fluid is then heated 134 to a temperature of about 145 degrees Fahrenheit. The cleaning fluid vapor is purged 136 from the enclosure 16, the reservoir 25, and control panels 65 by filling the areas with nitrogen and removing vapor to a storage container 116. The heat exchanger bundle is then cleaned 138 by spraying cleaning fluid on the bundle and continuously or periodically rotating the bundle within the enclosure 16 as previously discussed. The cleaning fluid vapor is then purged 140 once again from the enclosure 16, the reservoir 25, and control panels 65 by filling the areas with nitrogen and removing vapor to a storage container 116. The door 22 is then opened and the seal 80 is depressurized to release the seal. The heat exchanger tube bundle is removed 142 from the cleaning enclosure 16. The cleaning solvent is then drained 144 from the cleaning unit 10. The remaining debris is then removed 146 from the cleaning enclosure by using a vacuum truck system or the like. Accordingly, the method 120 of the present invention does not require transport of cleaning fluid to the cleaning site. By using cleaning fluid available at the facility, the used cleaning fluid can be recycled at the facility after being used to clean the bundles. No cleaning material is wasted or in need of disposal. This makes the whole cleaning process, cheaper, faster, and more environmentally friendly.

It will thus be seen that the method and system for cleaning a heat exchanger tube bundle has been illustrated and described and it will be apparent to those skilled in the art that various changes and modifications may be made therein without departing from the spirit of the invention.

What is claimed is:

1. A method of cleaning a heat exchanger bundle having reduced vapor emissions comprising the steps of:

providing a cleaning unit having a cleaning enclosure accessible by a top door and having a cleaning fluid reservoir;

opening the top door of the cleaning enclosure to provide access thereto;

loading at least one heat exchanger tube bundle into the cleaning enclosure;

closing the top door of the mobile cleaning unit and pressurizing a seal positioned about top door by removably introducing a fluid into an internal chamber of the seal to provide a fluid and vapor lock of the cleaning enclosure;

creating a vacuum and purging oxygen from at least one of the enclosure, the cleaning fluid reservoir, and a control panels by filling at least one of the enclosure, the reservoir, and the control panels with nitrogen; and cleaning the heat exchanger tube bundle by spraying a cleaning fluid comprising petroleum distillate on the bundle.

2. The method of claim 1, wherein the step of purging oxygen further comprises the step of filtering any gases displaced by the nitrogen purge with a carbon filter canister.

3. The method of claim 1 further comprising the step of transporting the mobile cleaning unit to a facility having a heat exchanger.

4. The method of claim 3 further comprising the step of filling the cleaning fluid reservoir of the mobile cleaning unit with a cleaning fluid comprising petroleum distillate obtained at the facility.

5. The method of claim 3 further comprising the step of unloading the cleaning fluid from the cleaning fluid reservoir of the mobile cleaning unit while the mobile cleaning unit is at the facility.

6. The method of claim 1 further comprising the step of heating the cleaning fluid to a temperature between about 145 degrees and 200 degrees Fahrenheit.

7. The method of claim 1, wherein the step of purging oxygen from at least one of the enclosure, the reservoir, and control panels is accomplished both prior to cleaning the heat exchanger tube bundle and after cleaning the heat exchanger tube bundle.

8. The method of claim 1 further comprising the step of opening the door and releasing the pressure in the vapor lock seal after cleaning the heat exchanger tube bundle.

9. The method of claim 1 further comprising the step of removing the cleaned heat exchanger tube bundle from the cleaning enclosure.

10. The method of claim 1, wherein the step of cleaning the heat exchanger tube bundle by spraying the cleaning fluid on the bundle is accomplished while continuously or periodically rotating the heat exchanger tube bundle within the enclosure.

11. The method of claim 1 further comprising the step of vacuuming debris from the cleaning enclosure.

12. A method of cleaning a heat exchanger bundle comprising the steps of:

providing a mobile cleaning unit having a cleaning enclosure accessible by a top door and having a cleaning fluid reservoir;

transporting the mobile cleaning unit to a facility having a heat exchanger;

filling the cleaning fluid reservoir of the mobile cleaning unit with a cleaning fluid comprising petroleum distillate obtained at the facility;

opening the top door of the cleaning enclosure to provide access thereto;

loading at least one heat exchanger tube bundle into the cleaning enclosure;

closing the top door of the mobile cleaning unit and pressurizing a seal positioned about top door by removably introducing a fluid into an internal chamber of the seal to provide a fluid and vapor lock of the cleaning enclosure;

creating a vacuum in the cleaning enclosure; and cleaning the heat exchanger tube bundle by spraying the cleaning fluid on the bundle.

13. The method of claim 12 further comprising the step of unloading the cleaning fluid from the cleaning fluid reservoir of the mobile cleaning unit back to the facility while the mobile cleaning unit is at the facility.

14. A method of cleaning a heat exchanger bundle comprising the steps of:

providing a mobile cleaning unit having a cleaning enclosure accessible by a top door and having a cleaning fluid reservoir;

transporting the mobile cleaning unit to a facility having a heat exchanger;

opening the top door of the cleaning enclosure to provide access thereto;

loading at least one heat exchanger tube bundle into the cleaning enclosure;

closing the top door of the mobile cleaning unit and pressurizing a seal by removably introducing a fluid into an internal chamber of the seal to provide a fluid and vapor lock of the cleaning enclosure;

filling the cleaning fluid reservoir of the mobile cleaning unit with a cleaning fluid comprising petroleum distillate obtained at the facility;

heating the cleaning fluid to a temperature between about 145 degrees and 200 degrees Fahrenheit;

creating a vacuum and purging oxygen from at least one of the enclosure, the reservoir, and a control panel by filling the at least one of the enclosure, the reservoir, and the control panel with nitrogen such that any displaced gasses are filtered by a carbon filter canister;

cleaning the heat exchanger tube bundle by spraying cleaning fluid on the bundle and continuously or periodically rotating the heat exchanger tube bundle within the enclosure;

removing the at least one heat exchanger tube bundle from the cleaning enclosure; and removing the cleaning fluid from the reservoir of the mobile cleaning unit by returning the cleaning fluid back to the facility.

15. The method of claim 14 further comprising the step of opening the door and releasing the pressure in the vapor lock seal after cleaning the heat exchanger tube bundle.

16. The method of claim 14, wherein the step of purging oxygen from at least one of the enclosure, the reservoir, and control panels is accomplished both prior to cleaning the heat exchanger tube bundle and after cleaning the heat exchanger tube bundle.

17. A system for cleaning heat exchanger tube bundles comprising:

a mobile cleaning unit comprising a tube bundle receiving reservoir enclosure having a bottom, upstanding opposing sidewalls and end walls, and at least one door pivotally secured to one of said sidewalls, a cleaning fluid sump in communication with the tube bundle receiving reservoir enclosure, a plurality of drive roller assemblies and guide roller assemblies positioned in the tube bundle receiving reservoir enclosure to receive the heat exchanger tube bundles, an adjustable spray means positioned in the tubular bundle receiving reservoir enclosure for spraying a cleaning fluid over the length of the heat exchanger tubular bundle, a pump and filter assembly for recirculating the cleaning fluid from the sump to the adjustable spray means, a cleaning fluid supply reservoir interconnected with the sump, a means for heating the cleaning fluid in the supply reservoir to a temperature between about 145 degrees and 200 degrees Fahrenheit prior to recirculating through the pump and filter assembly, a means for controlling the drive roller assembly, the pump and filter assembly, and the means for heating the cleaning fluid in the cleaning fluid supply reservoir, the controlling means comprising a plurality of explosion-proof control elements housed in a cabinet, and a vapor lock seal comprising an interior chamber, the seal positioned between the top of the reservoir enclosure and the door, the seal effectively closing a gap between the door and the walls of the enclosure to prevent the escape of gas or fluid from the receiving enclosure when the interior chamber of the seal by removably introducing a fluid into an internal chamber of the seal; and a suction pump adapted to creating a vacuum to remove gases from the receiving enclosure.

18. The system of claim 17 further comprising a vapor purge system comprising:

a source nitrogen gas connected to at least one of the reservoir enclosure, the cleaning fluid sump, and the controls cabinet, and a vapor filter canister connected to an exhaust at least one of the reservoir enclosure, the cleaning fluid sump, and the controls cabinet.

19. The system of claim 17, wherein the drive roller assemblies are driven by a hydraulic motor.

20. The system of claim 19, wherein the hydraulic motor is a variable speed drive motor to provide continuous or periodic rotation of the heat exchanger tube bundle within the reservoir enclosure.

* * * * *